US010420400B1

(12) United States Patent
Erdal

(10) Patent No.: US 10,420,400 B1
(45) Date of Patent: Sep. 24, 2019

(54) SYSTEM FOR ZIPPERS

(71) Applicant: Abdullah C. Erdal, Santa Clara, CA (US)

(72) Inventor: Abdullah C. Erdal, Santa Clara, CA (US)

( * ) Notice: Subject to any disclaimer, the term of this patent is extended or adjusted under 35 U.S.C. 154(b) by 0 days.

(21) Appl. No.: 16/058,062

(22) Filed: Aug. 8, 2018

Related U.S. Application Data

(60) Provisional application No. 62/698,980, filed on Jul. 17, 2018.

(51) Int. Cl.
*A44B 19/28* (2006.01)
*A44B 19/26* (2006.01)

(52) U.S. Cl.
CPC ..... *A44B 19/28* (2013.01); *A44B 19/262* (2013.01)

(58) Field of Classification Search
CPC ..... A44B 19/26; A44B 19/28; A44B 19/262
See application file for complete search history.

(56) References Cited

U.S. PATENT DOCUMENTS 2,224,930 A * 12/1940 Roseman ..... A44B 19/24 223/111
2,701,903 A * 2/1955 Williams ..... A44B 19/301 24/386
4,081,882 A * 4/1978 Toepelt ..... A44B 19/301 24/386
4,123,829 A * 11/1978 Takabatake ..... A44B 19/301 24/386
4,350,375 A * 9/1982 Bako ..... A44B 19/301 24/386
4,930,323 A * 6/1990 Terada ..... A44B 19/301 70/68
4,976,120 A * 12/1990 Terada ..... A44B 19/301 70/312
5,697,130 A * 12/1997 Smith ..... A44B 19/38 24/381
5,791,023 A * 8/1998 Comerford ..... A44B 19/36 24/386
6,510,593 B1 * 1/2003 Kim ..... A44B 19/301 24/382
7,293,334 B2 11/2007 Metzger
7,304,600 B2 12/2007 Nehls et al.
7,506,417 B2 * 3/2009 Yoneoka ..... A44B 19/301 24/386
8,079,625 B2 12/2011 Arney et al.
8,764,081 B1 7/2014 Krieger
9,027,210 B2 5/2015 Peters et al.
9,149,092 B2 10/2015 Damon et al.
9,706,816 B2 7/2017 Coakley et al.

* cited by examiner

*Primary Examiner* — Robert Sandy
*Assistant Examiner* — David M Upchurch

(57) ABSTRACT

An apparatus having a left-hand side slider including a left-hand side splitter and configured to slide along a left-hand side zipper chain; a right-hand side slider including a right-hand side splitter and configured to slide along a right-hand side zipper chain; the left-hand side slider and right-hand side slider, when placed in contact with each other, allow the left-hand side splitter and right-hand side splitter to act as a single splitter.

20 Claims, 20 Drawing Sheets

SYSTEM FOR ZIPPERS

CROSS REFERENCE TO RELATED APPLICATIONS

This application claims priority to U.S. Provisional Patent Application No. 62/698980 filed on Jul. 17, 2018 entitled "Improved System for Zippers," the contents of which are hereby incorporated by reference in their entirety.

FIELD OF THE INVENTION

The present invention relates to a system for connecting two materials. More particularly, the present invention relates to a zipper that is configured with an axially bisected slider, including a left-hand side (LHS) and a right-hand side (RHS). Even more particularly, the LHS slider and RHS slider can be configured to attach to a zipper chain without a need for an insertion pin or other traditional mechanism used to insert one side of the zipper chain into the slider.

DESCRIPTION OF RELATED ART

Most zippers are used to connect two materials, including two pieces of fabric, together. To do this, zippers typically require a slider that is connected to a first piece of fabric, leaving the second piece of fabric free to be inserted into the slider through insertion pin. Once the second piece of fabric is inserted into the slider, the zipper can be "zipped," or pulled up (or in any direction that closes the zipper), thereby connecting the two materials. Unfortunately, this typical configuration can be difficult for young children, older adults, and others who lack manual dexterity.

FIG. 1 is a face-down view of an example of the prior-art. In this drawing, the zipper system includes a top tape 1 (also called right-hand tape), and a bottom tape 13 (also called left-hand tape). Top tape 1 is connected to the first piece of fabric (not shown), while bottom tape 13 is connected to the second piece of fabric (not shown). The connections can be with thread, glue, or any other known method, including being woven integrally into their respective pieces of fabric.

Chain or zipper teeth 6 are in two halves, with each half in fixed contact with each of top tape 1 and bottom tape 13, respectively. The zipper shown in FIG. 1 includes slider 3 that is slidably coupled to one half of chain 6, and thereby coupled to the first piece of fabric. When moved to an extreme lower position, slider 3 is stopped by bottom stop 7. ?

FIG. 2 is a close-up view of one end of a zipper system. When in use, insertion pin 10 is inserted through slider 3 and into retainer box 11 in a way that aligns each half of the zipper chain so that when slider 3 is moved, the two halves of chain 6 are forced together to connect the first piece of fabric to the second piece of fabric.

In both FIGS. 1 and 2, to move slider 3 along chain 6, a user can grasp pull tab (also called a puller) 4, which is connected to slider 3, and is configured to be pulled in one direction or another, colloquially called "up" (the direction in which slider 3 is moved to connect the two halves of chain 6) and "down" (the direction in which slider 3 is moved to separate the connected halves of chain 6).

When the zipper is fully zipped up, slider 3 is found at the end of the zipper chain, and is stopped by top stop 2.

FIGS. 3 and 4 display a perspective view of slider 3 with pull tab 6. FIG. 3 includes slider 3, which is a single piece, with a top piece 21 that includes a hinge connection 23 for pull tab 6, and a bottom 22 connected to top 21. Bottom 22 is typically connected by a physical connection within the interior of slider 3. Slider 3 further includes slider gap 24, which allows slider 3 to slide up and down a zipper chain, but is constrained by the width of the zipper chain which is typically wider than the slider gap 24.

FIG. 4 is a bottom view of slider 3, that includes bottom piece 22, top piece 21, pull tab 6, and slider gap 24.

In both FIGS. 3 and 4, one can see that lower opening 204 is unitary, and is configured to allow inclusion of a both halves of a chain to sit side by side, with one half of the chain inserted using an insertion pin.

FIG. 5 displays the same slider as in FIGS. 3 and 4, and shows upper opening 205. As can be seen in FIG. 5, upper opening 205 is in two halves to accommodate each half of a chain.

FIG.6 shows an upper and lower exploded view of slider 3. As can be seen in this FIG. 6, top piece 301 and bottom piece 302 are unified by splitter 303, situated between and in contact with both top piece 301 and bottom piece 302. As is shown in FIG. 6, splitter 303 is roughly wedge shaped and extends only a portion of the way from one end of splitter 303 to the other end of splitter 303 such that one end of the slider includes two openings, each opening configured to receive a half a zipper chain; the other end of splitter 303 includes a single opening configured to allow the joined halves of the zipper chain to pass through when physically connected to form a single zipper chain.

FIG. 7 is a perspective view of slider 3, from the top, showing top 701, bottom 702, gap 703, and lower opening 704.

As discussed above, users with limited manual dexterity may have trouble using existing zippers. They may have trouble inserting an insertion pin into a slider, or they may have trouble manipulating the pull tab. Thus, a need exists to provide a zipper apparatus that works with many of the existing components of current zippers, but allows for easier use by those with limited manual dexterity.

SUMMARY OF THE INVENTION

Embodiments of the present invention provide a solution for combining two pieces of material that are appropriate for being combined by a zipper. Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that numerous modifications, equivalents, and alternative constructions exist, each that fall within the spirit and scope of the invention as expressed in the claims.

Generally, embodiments of the present invention include a system configured to provide a user with the ability to combine to materials together using zipper teeth. In one illustrative embodiment of the present invention, an apparatus comprises a left-hand side slider including a left-hand side splitter and configured to slide along a left-hand side zipper chain; a right-hand side slider including a right-hand side splitter and configured to slide along a right-hand side zipper chain; the left-hand side slider and right-hand side slider configured to be in contact with each other such that the left-hand side splitter and right-hand side splitter are capable of acting as a single splitter.

BRIEF DESCRIPTION OF THE DRAWINGS

The structure and the technical means adopted by the present invention to achieve the above and other objects can best be understood by referring to the following detailed description of certain embodiments and the accompanying drawings, wherein.

DETAILED DESCRIPTION OF THE PREFERRED EMBODIMENT

For the purposes of the present invention, LHS is synonymous with "left hand" and "left-hand," and RHS is synonymous with "right hand" and "right-hand."

Figure 1:
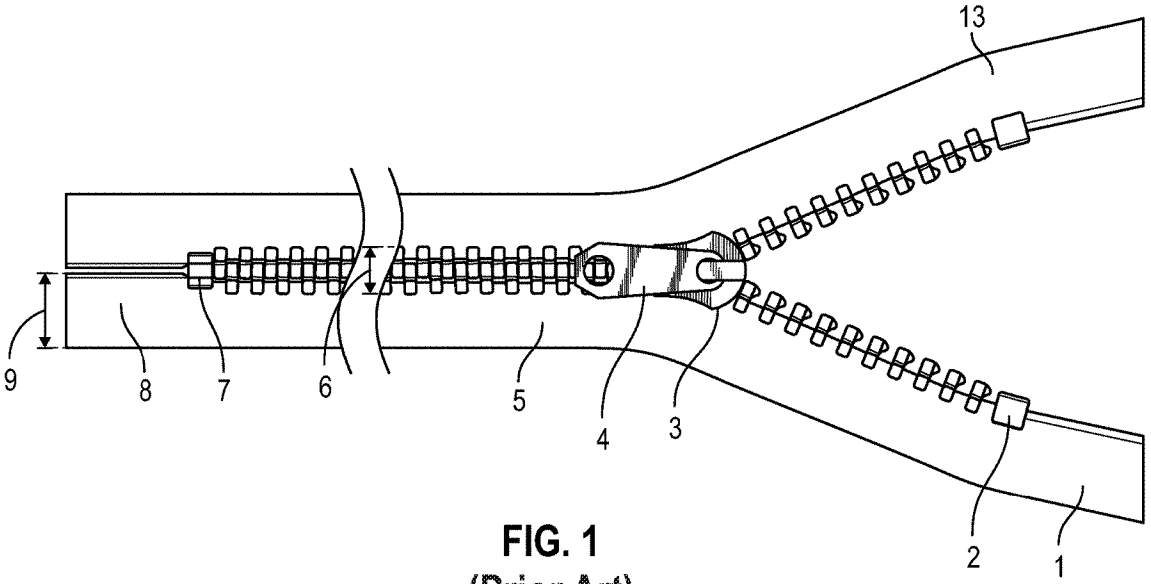
FIG. 1 (Prior Art)
FIG. 1 illustrates a view of a prior-art embodiment of components of a zipper.
Figure 2:
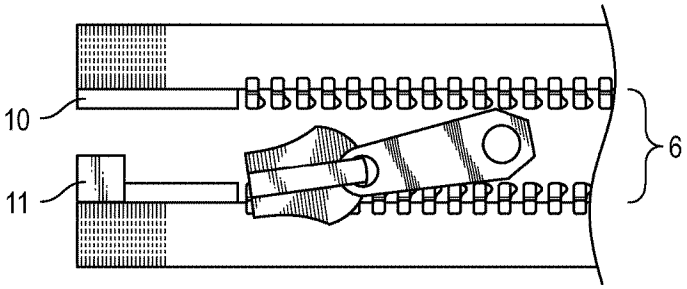
FIG. 2 (Prior Art)
FIG. 2 illustrates a close-up view of a prior-art embodiment of components of a zipper.
Figure 4:
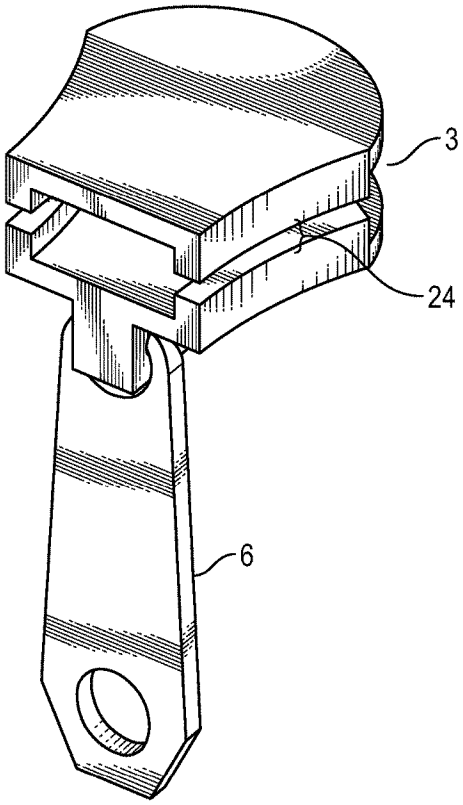
FIG. 4 (Prior Art)
FIG. 4 illustrates a perspective face-down view of a prior-art embodiment of a zipper slider with a pull tab.
Figure 3:
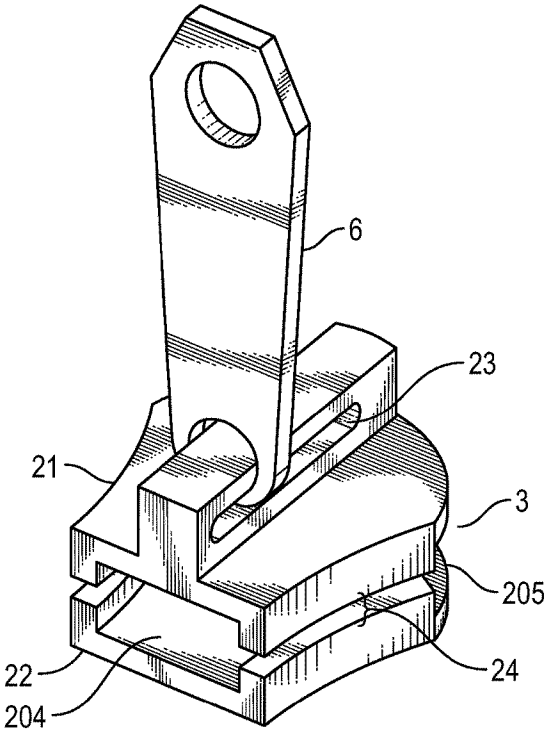
FIG. 3 (Prior Art)
FIG. 3 illustrates a perspective face-up view of a prior-art embodiment of a zipper slider with a pull tab.
Figure 5:
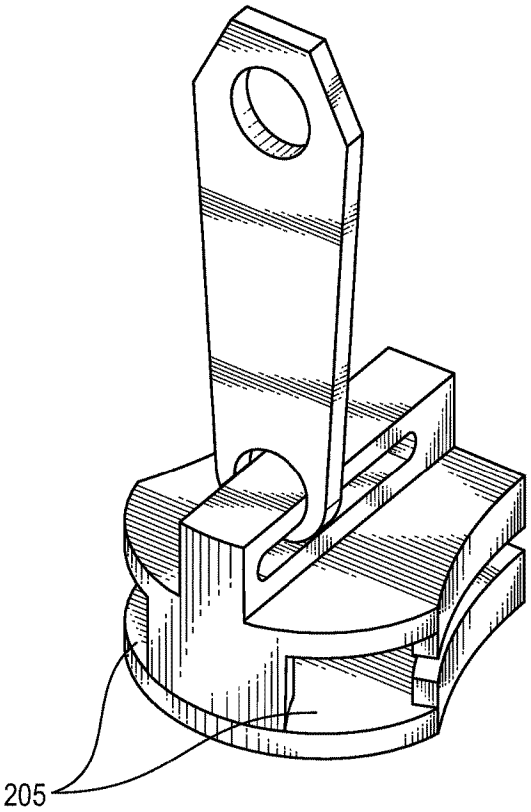
FIG. 5 (Prior Art)
FIG. 5 illustrates a perspective face-up view of a prior-art embodiment of a zipper slider with a pull tab.
Figure 6:
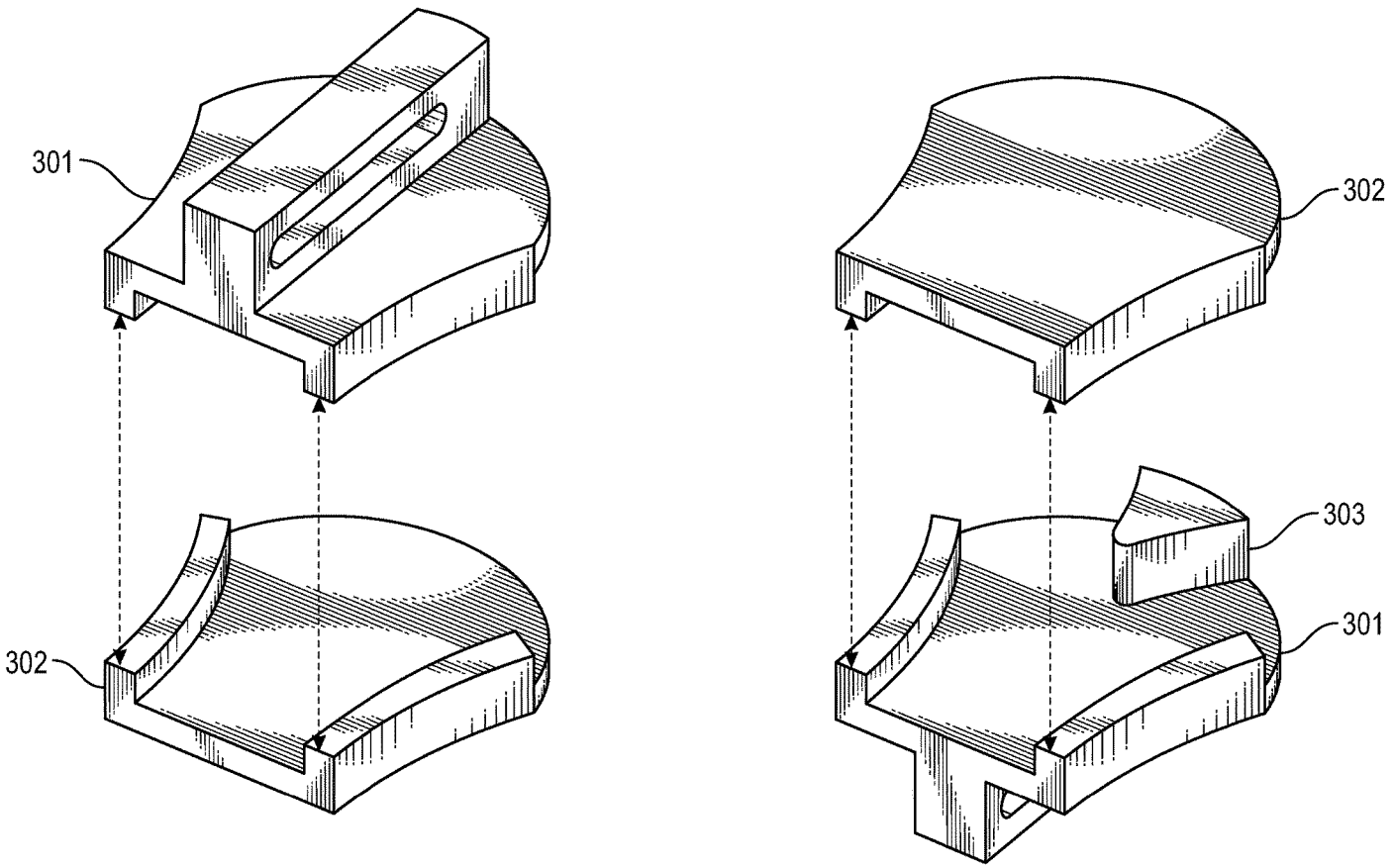
FIG. 6 (Prior Art)
FIG. 6 illustrates a perspective exploded view of a prior-art embodiment of a zipper.
Figure 7:
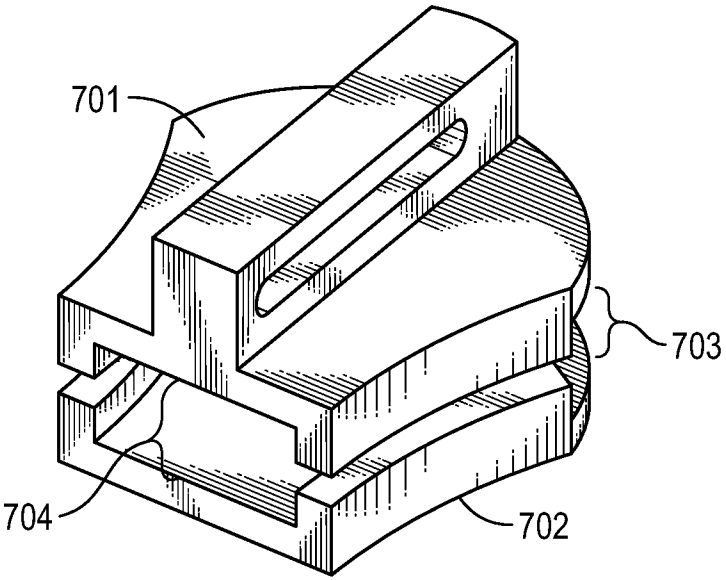
FIG. 7 (Prior Art)
FIG. 7 illustrates a perspective view of a prior-art embodiment of a slider.
Figure 8:
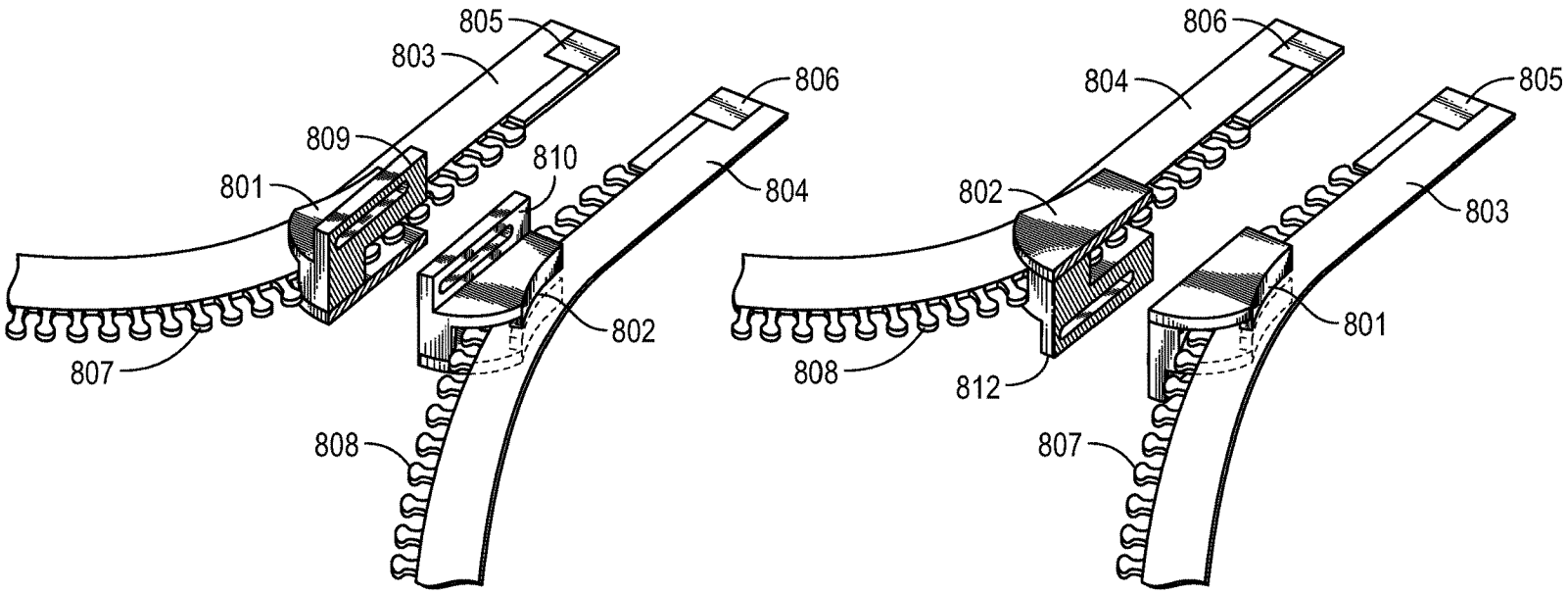
FIG. 8 illustrates an embodiment of the invention, including a top and bottom view of left and right parts of a split slider with a left and right zipper chain.

FIG. 8 displays both a top and bottom perspective view of an embodiment of the present invention that includes LHS slider 801, RHS slider 802, LHS tape 803, RHS tape 804, LHS bottom stop 805, RHS bottom stop 806. In this embodiment, LHS slider 801 is slidably coupled to LHS zipper teeth 807, and can extend as far as LHS bottom stop 805, which prevents LHS slider 801 from sliding off LHS tape 803. Likewise, RHS slider 802 is slidably coupled to RHS zipper teeth 808, and can extend as far as RHS bottom stop 806, which prevents RHS slider 802 from sliding off RHS tape 804. In one embodiment, LHS slider 801 includes a LHS pull tab loop 809. In another embodiment, RHS slider 802 includes a RHS pull tab loop 810. In yet another embodiment, both RHS and LHS sliders include a pull tab loop.

In an embodiment, LHS slider 801 includes left-hand contact face 811, which is configured to be in contact with right-hand contact face 812 on RHS slider 802. Once in contact along their respective contact faces, LHS slider 801 and RHS slider 802 are configured to act as a traditional zipper slider, that is, a single or unitary slider, and is capable of zipping up, combining zipper chains 807 and 808, and unzipping, or disconnecting, the combined zipper chains back into separate zipper chain 807 and 808.

Figure 9:
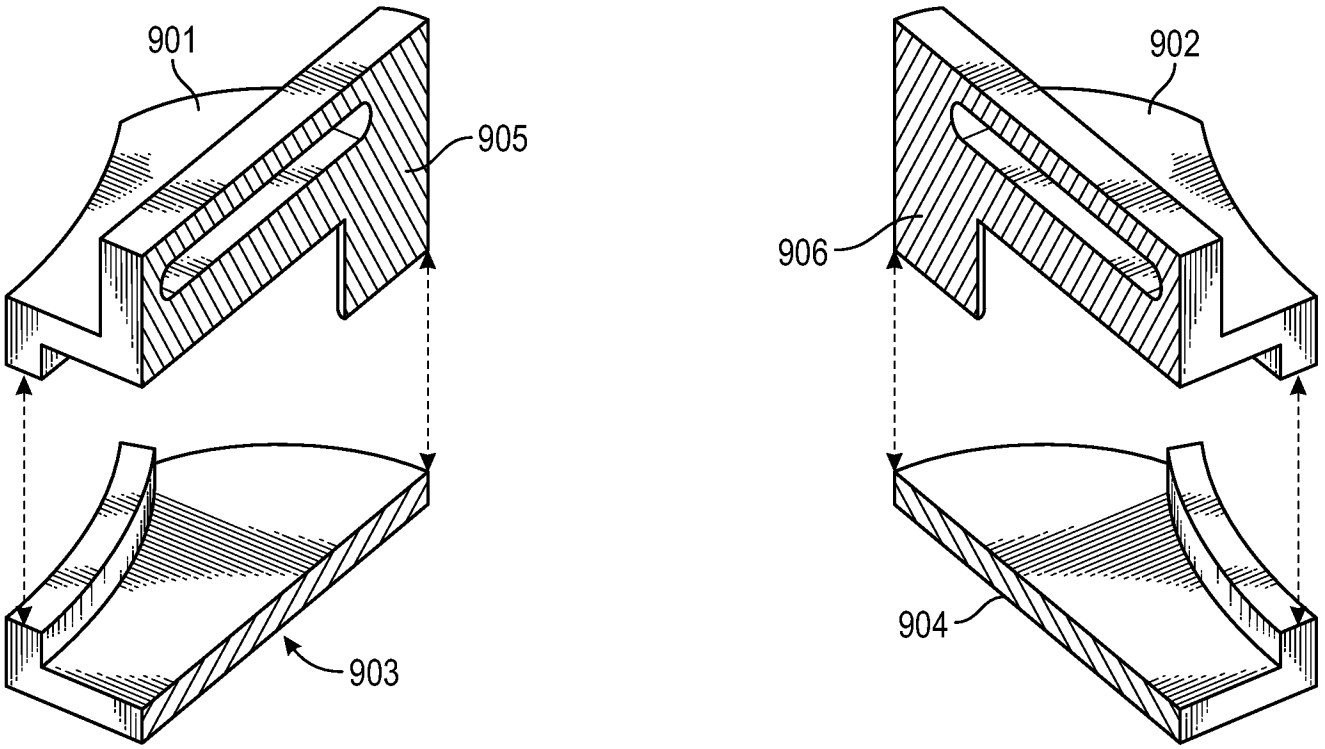
FIG. 9 illustrates an exploded view of an embodiment of the invention including left-hand zipper slider and a right-hand zipper slider.

FIG. 9 is an exploded view of both an LHS slider and an RHS slider, according to an embodiment. LHS slider includes LHS top piece 901, LHS bottom piece 903, both held together by LHS, or left-hand, splitter 905. In an embodiment, RHS slider includes RHS top piece 902, RHS bottom piece 904, and RHS splitter 906. In an embodiment, LHS top piece 901 is fixedly connected to LHS bottom piece 903 by LHS splitter 905; RHS top piece 902 is fixedly connected to RHS bottom piece 904 by RHS splitter 906. In an embodiment, LHS splitter 905 is formed as part of the LHS top piece 901, and RHS splitter 906 is formed as part of RHS top piece 902. In an embodiment, LHS splitter 905 can be formed as part of LHS bottom piece 903, and RHS splitter 906 can be formed as part of RHS bottom piece 904. In another embodiment, LHS splitter 905 and RHS splitter 906 are formed individually and attached to its respective bottom or top piece.

Regardless of how LHS splitter 905 and RHS splitter 906 are formed, when each is in contact with the other, they act as a single traditional splitter. In an embodiment, LHS splitter 905 is shaped as one half of a substantially wedge-shaped splitter, while RHS splitter 906 is shaped as the other half of a substantially wedge-shaped splitter.

Figure 10:
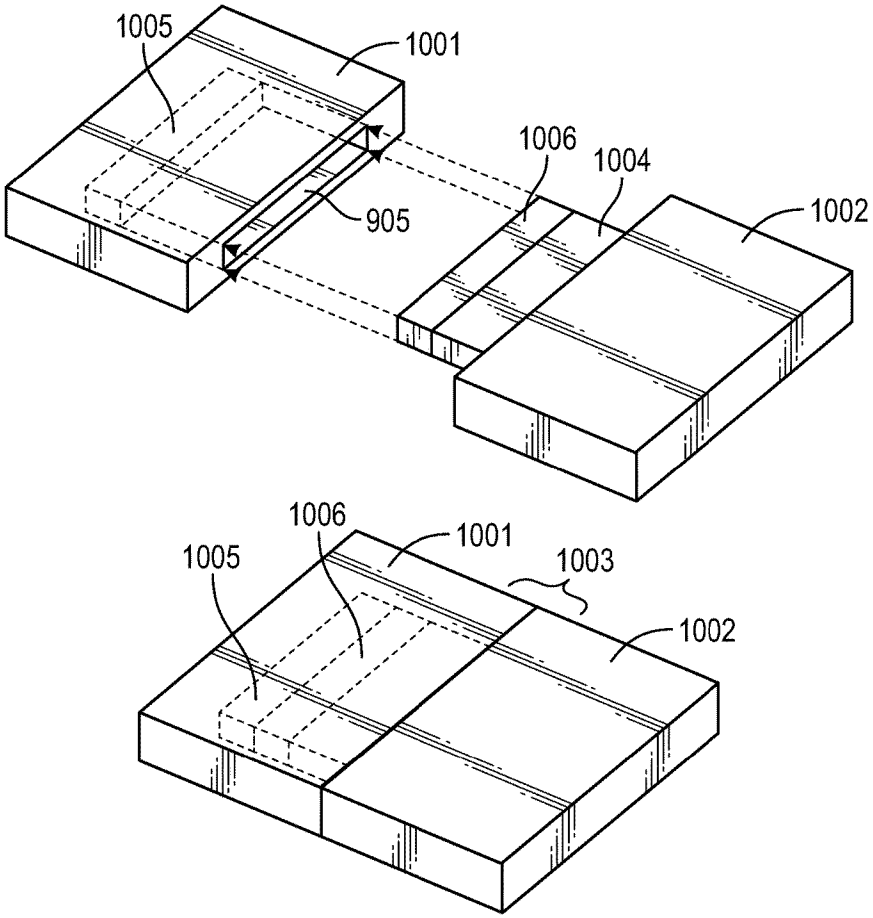
FIG. 10 illustrates an embodiment of the present invention including a left-hand, or female slider holder, and a right-hand, or male slider holder.

FIG. 10 displays an embodiment of the invention including female slider holder 1001, male slider holder 1002, and the combined slider holder 903 where male slider holder 1002 is inserted into female slider holder 1001, creating a single slider holder. In this embodiment, male slider 1002 includes insertion tab 1004, and is configured to be inserted into slot 1005.

Figure 11:
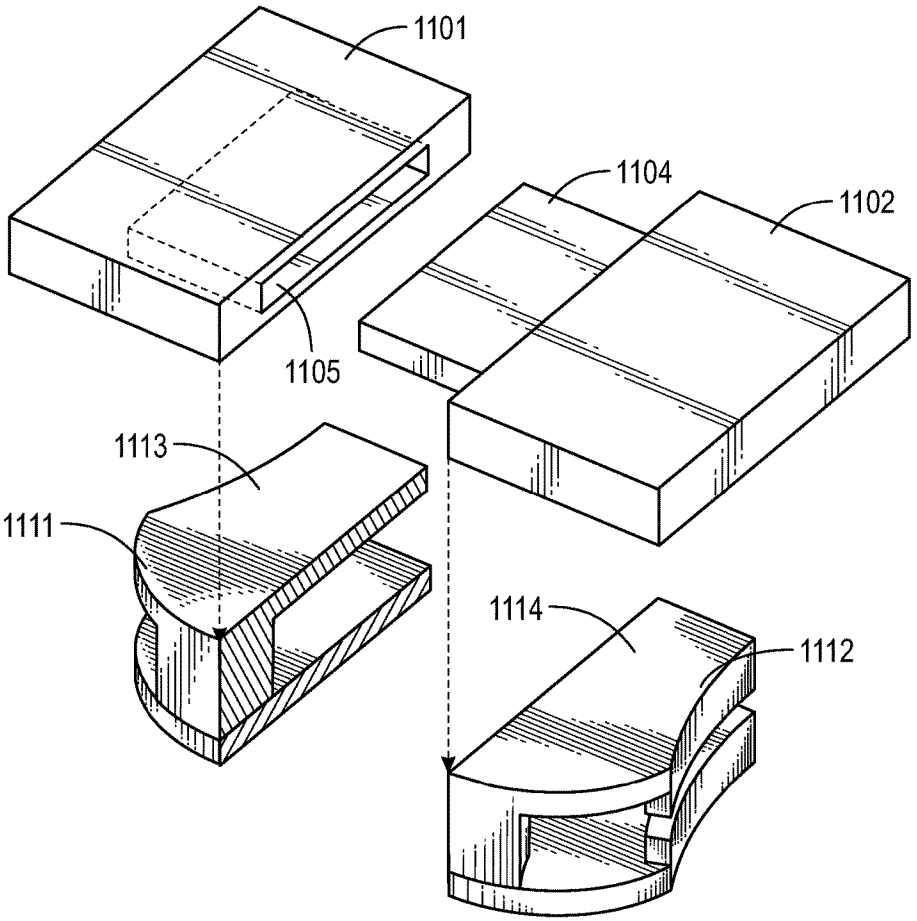
FIG. 11 illustrates an embodiment of the invention including a male and female slider holder paired with a right and left side slider part.

FIG. 11 displays an embodiment in which female slider holder 1101, also called RHS slider holder 1101, is configured to be attached to the upper face 1113 of RHS slider 1111, and male slider holder 1102, also called LHS slider holder 1102, is configured to be attached to the upper face 1114 of LHS slider 1112. In another embodiment, female slider holder 1101 is manufactured as part of RHS slider 1111, and male slider holder 1102 is manufactured as part of LHS slider 1112, rather than being manufactured individually and then attached afterwards. In an embodiment, insertion tab 1104 is configured to be inserted into slot 1105 such that, when insertion tab 1104 is inserted into slot 1005, RHS slider 1111 and LHS slider 1112 are placed in communication in a way that allows them to function as a single slider.

Figure 12:
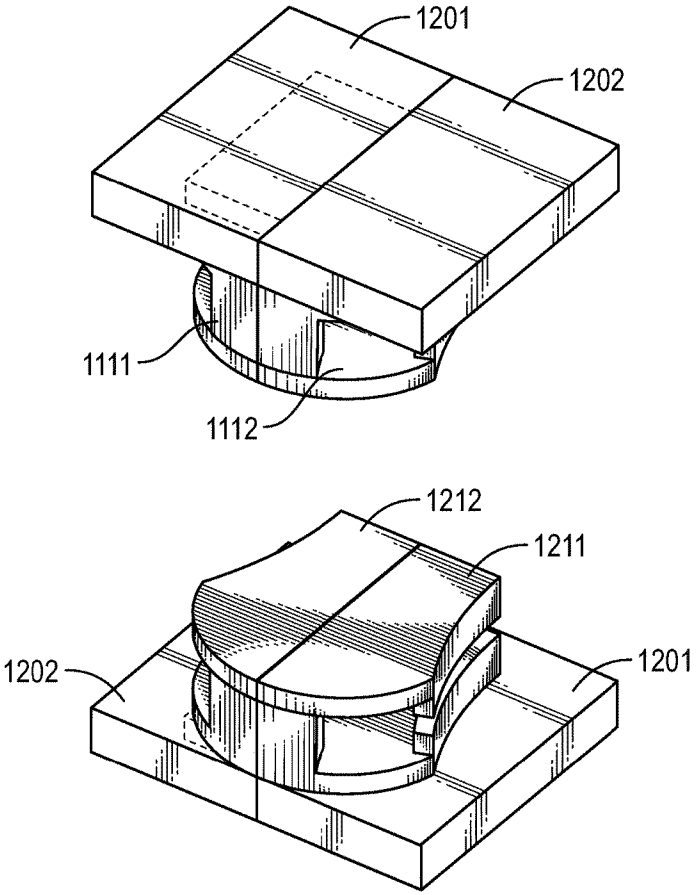
FIG. 12 illustrates an embodiment of the invention including a bottom-front and top-front view of a slider joined to a slider-holder.

FIG. 12 displays a perspective view of an embodiment of the present invention in which female slider holder 1201 is connected to RHS slider 1211, and male slider holder 1202 is connected to LHS slider 1212. In an embodiment, male slider 1202 is connected to female slider holder 1201, allowing RHS slider 1201 and LHS slider 1202 to function as a unitary or single slider. One skilled in the art will understand that female slider holder 1201 can also be called LHS slider holder, and male slider holder 1202 can also be called RHS slider holder.

Figure 13:
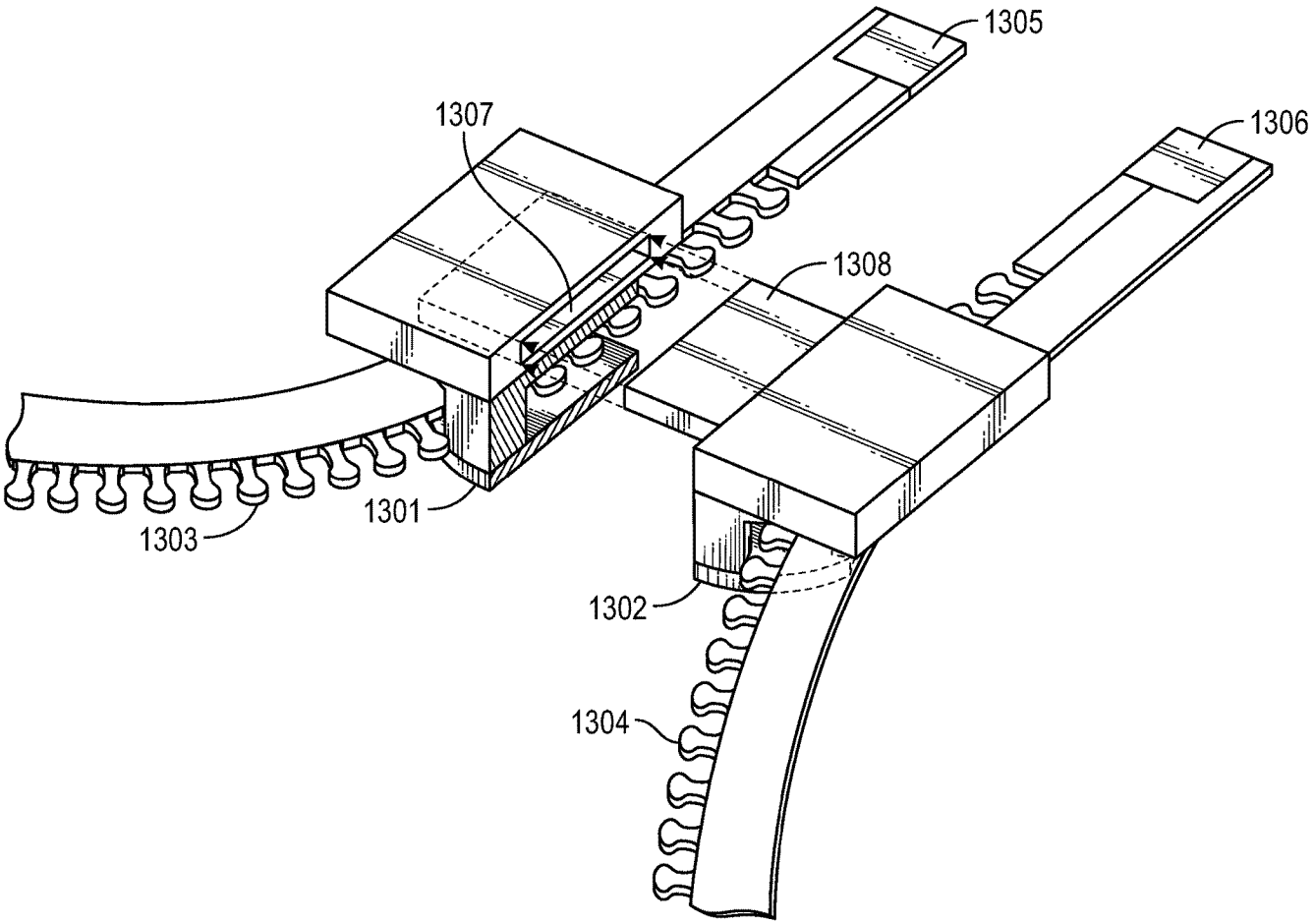
FIG. 13 illustrates an embodiment of the invention including a front view of a left-hand slider holder connected to the top of a left-hand slider that is slidably connected to a left-hand zipper chain, and a right-hand slider holder connected to the top of a right-hand slider that is slidably connected to a right-hand zipper chain.

FIG. 13 is an embodiment of the invention showing a top view of the zipper mechanism. In this embodiment, LHS slider 1301 is coupled to LHS zipper teeth 1303, and RHS slider 1302 is coupled to RHS zipper teeth 1304. To fully zip the zipper from top to bottom, in this embodiment, both LHS slider 1301 and RHS slider 1302 are positioned in contact with LHS stopper 1305 and RHS stopper 1306. Next, insertion tab 1308 is inserted into slot 1307, forming a single slider capable, when moved, of attaching LHS zipper teeth 1203 to RHS zipper teeth 1304.

Figure 14:
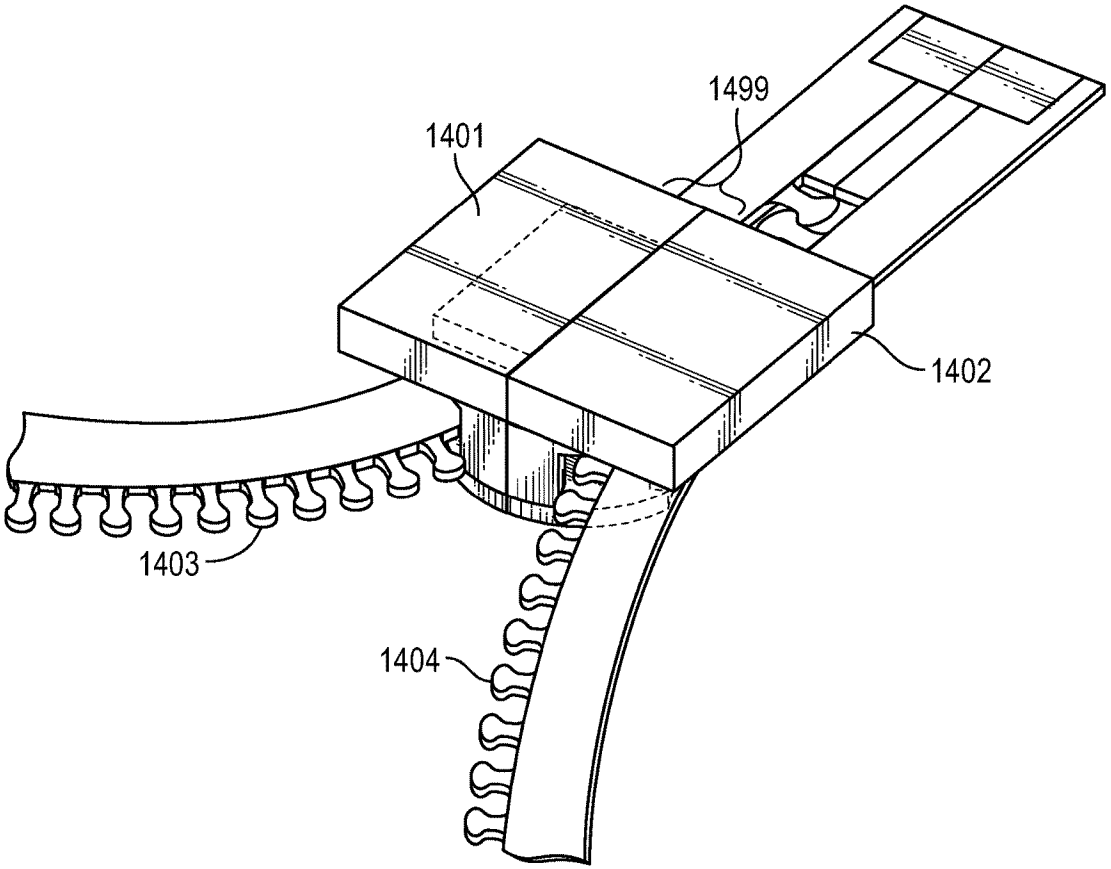
FIG. 14 illustrates an embodiment of the invention including a front view of a left-hand slider and left-hand slider holder connected to a right-hand slider and right-hand slider holder.

FIG. 14 is an embodiment of the invention showing LHS slider 1401 and RHS slider 1402 connected together to form single slider 1499. In this figure, single slider 1499 has been slid partially along zipper teeth 1403 and 1404, forcing them together to join the two sides.

Figure 15:
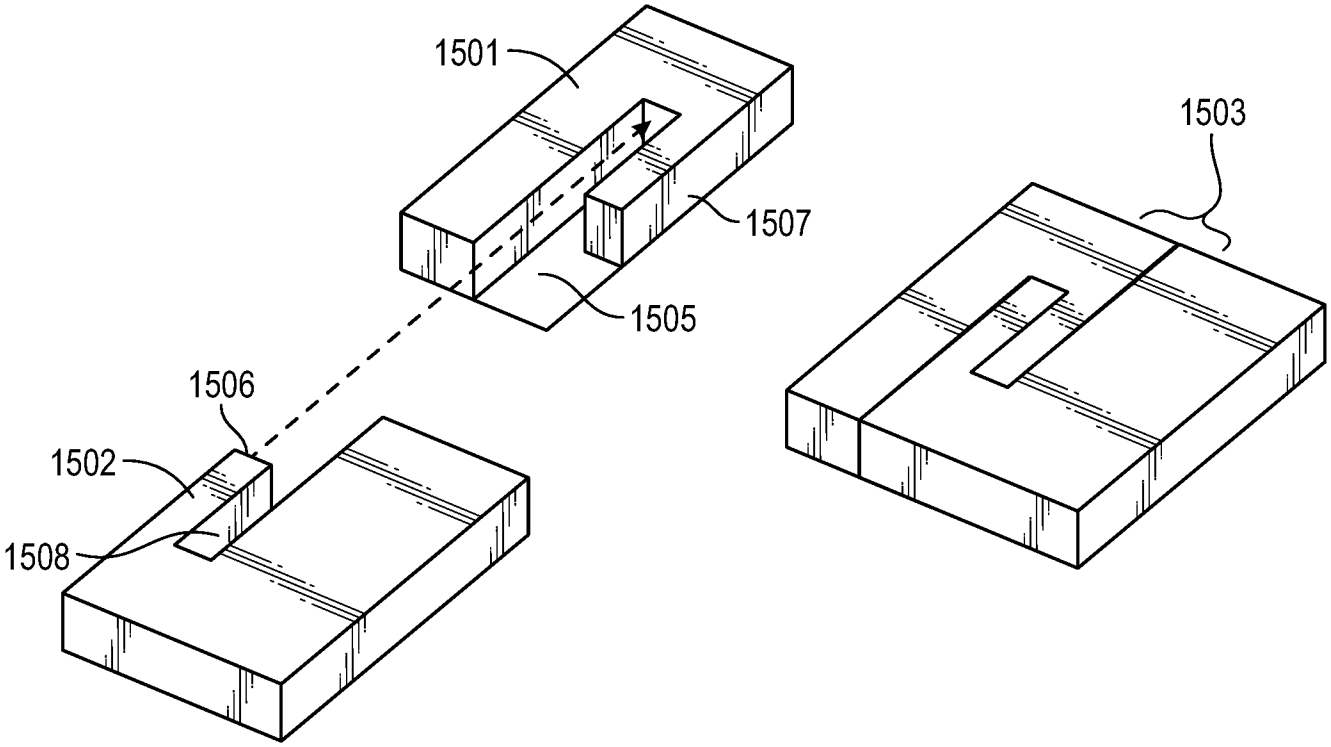
FIG. 15 illustrates an embodiment of the invention including a left-hand slider holder and a right-hand slider holder, and a slot and tab assembly for joining the two pieces together.

FIG. 15 is an embodiment of the invention showing a method of attaching LHS slider holder 1501 to RHS slider holder 1502 to form unitary slider holder 1503. In this embodiment, LHS slider holder 1501 include substantially u-shaped left-hand cut-out area 1505, also called slot 1505, configured to receive right-hand tab 1506. In addition, RHS slider holder 1502 includes a substantially u-shaped right-hand cut-out area 1508 configured to receive left-hand tab 1507 such that, when placed together, allows for formation of a unit that functions as a single slider. In one embodiment, LHS slider holder 1501 and RHS slider holder 1502 are formed separately from the LHS slider and the RHS slider, as is shown in 13D. In another embodiment, LHS slider holder 1501 and RHS slider holder 1502 are formed integrally with the LHS and RHS slider, forming a single LHS piece and a single RHS piece. In an embodiment, the left-hand cut-out area forms left-hand tab 1507, and right-hand cut-out area forms right-hand tab 1506.

Figure 16:
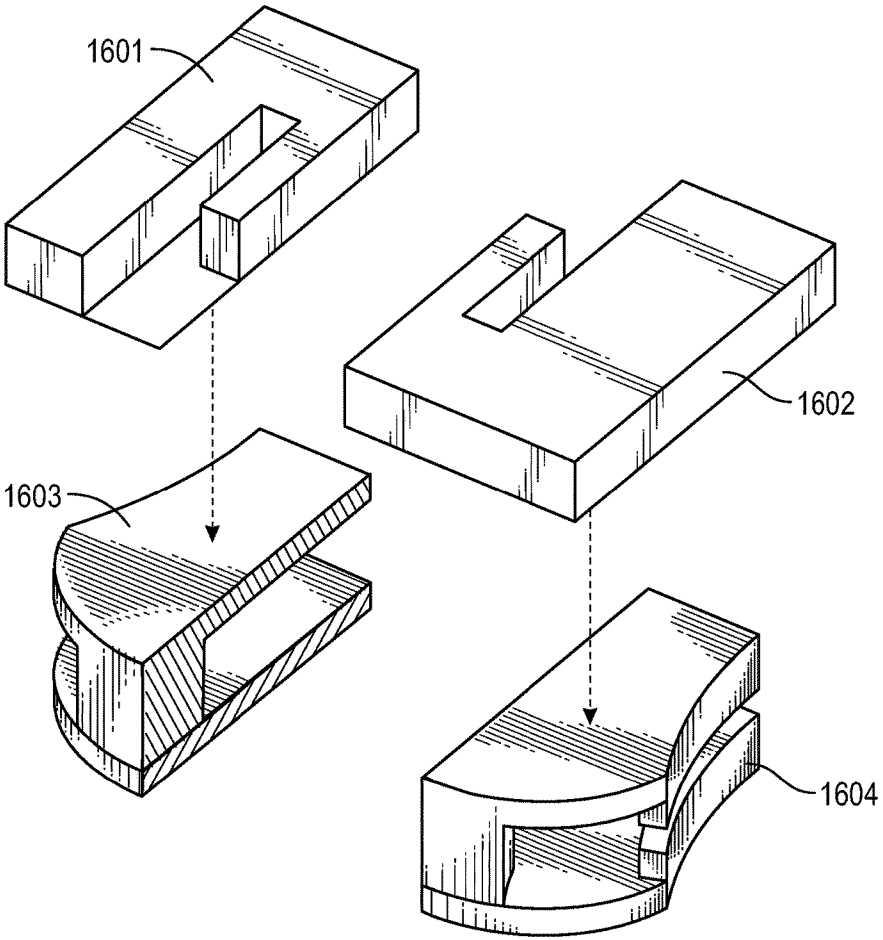
FIG. 16 illustrates an embodiment of the invention displaying the relationship between a left-hand and right-hand slider holder and a left-hand and right-hand slider, respectively.
Figure 17:
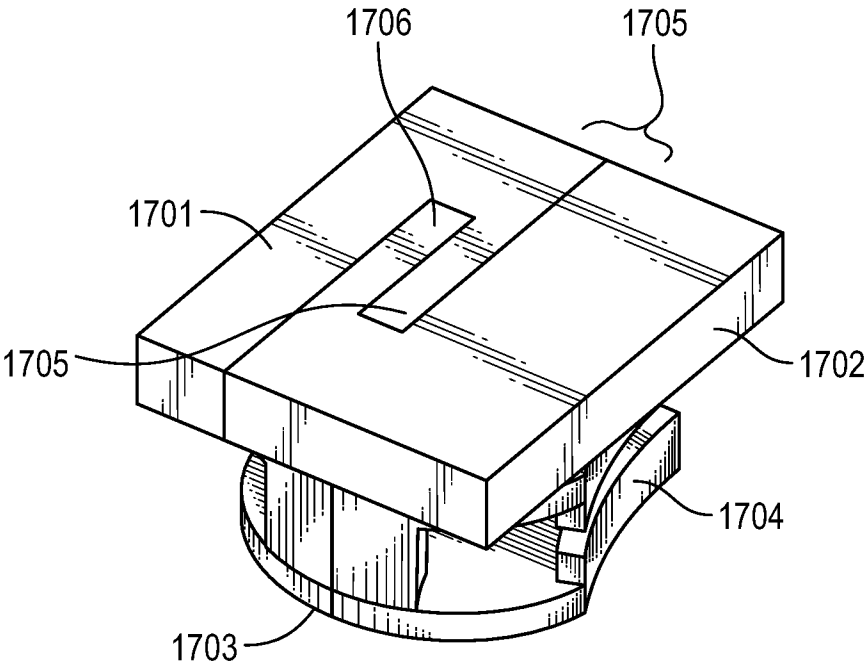
FIG. 17 illustrates an embodiment of the invention including a joined left-hand slider holder and right-hand slider holder.

FIG. 16 displays an embodiment of the invention showing the relationship between LHS slider holder 1601 and RHS slider 1603, and also the relationship between RHS slider holder 1602 and RHS slider 1604, according to an embodiment of the invention. FIG. 17 displays a perspective view of an embodiment of the invention showing LHS slider holder connected to LHS slider 1703, locked in place with RHS slider holder 1702, which is connected to RHS slider 1704. In this embodiment, LHS slider holder 1701 couples with RHS slider holder 1702 to form a single slider holder 1703. In this embodiment, insertion tab 17606 inserts into slot 1705, thus locking together the two halves.

Figure 18:
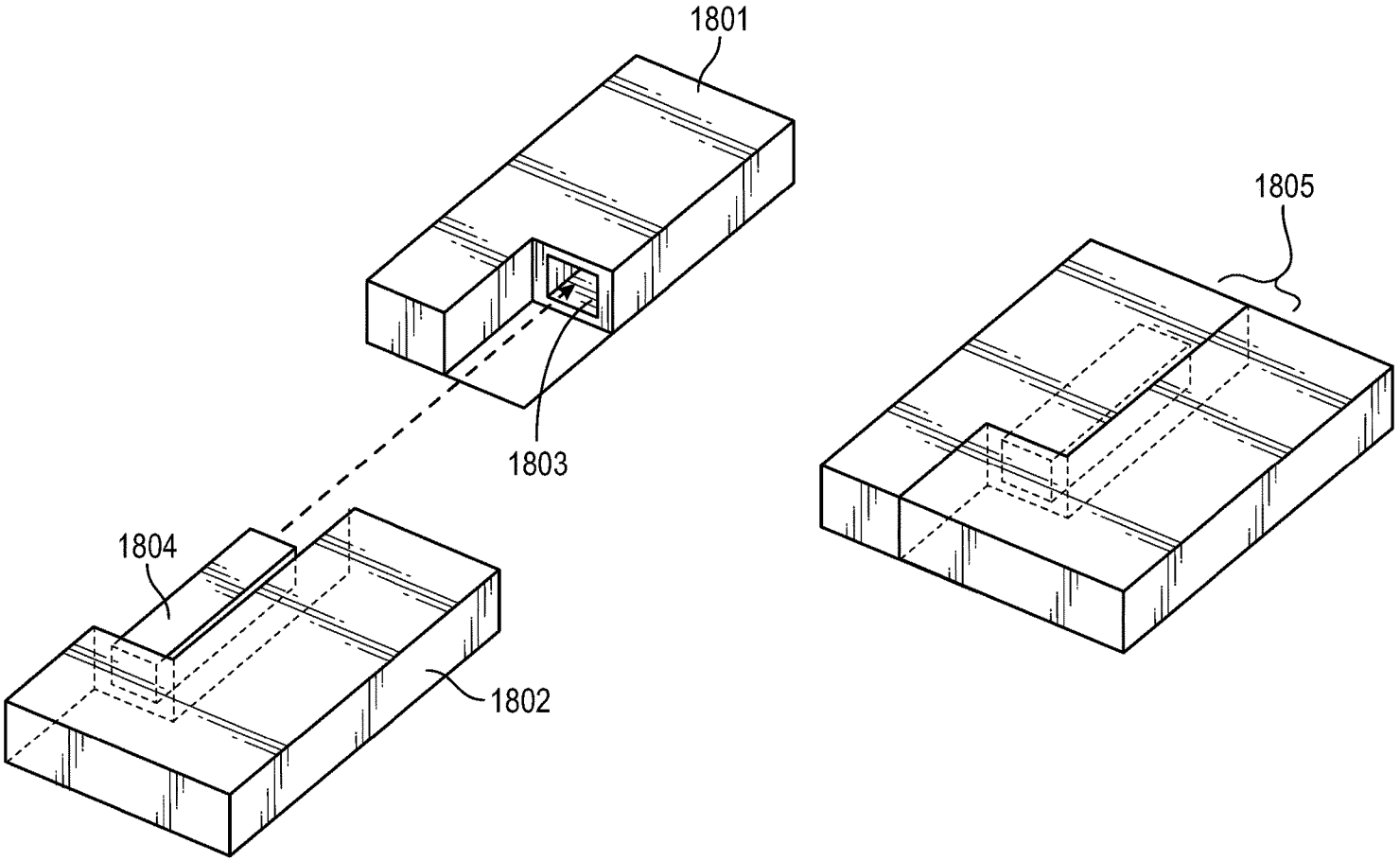
FIG. 18 illustrates an embodiment of the invention including a slider-holder assembly including a slot and tab configuration.

FIG. 18 displays an embodiment of the invention that includes LHS slider holder 1801 configured to couple with RHS slider holder 1802 to form a single slider holder 1805. In this embodiment, insertion tab 1804 inserts into slot 1803, thus locking together the two halves to form unitary piece 1805, according to an embodiment. In an embodiment, slot 1804 is internal to LHS slider holder 1801 and is substantially rectangular in cross section; insertion tab 1804 is external to RHS slider holder 1803, and is also substantially rectangular in cross section such that insertion tab 1804 is configured to fit into slot 1803.

Figure 19:
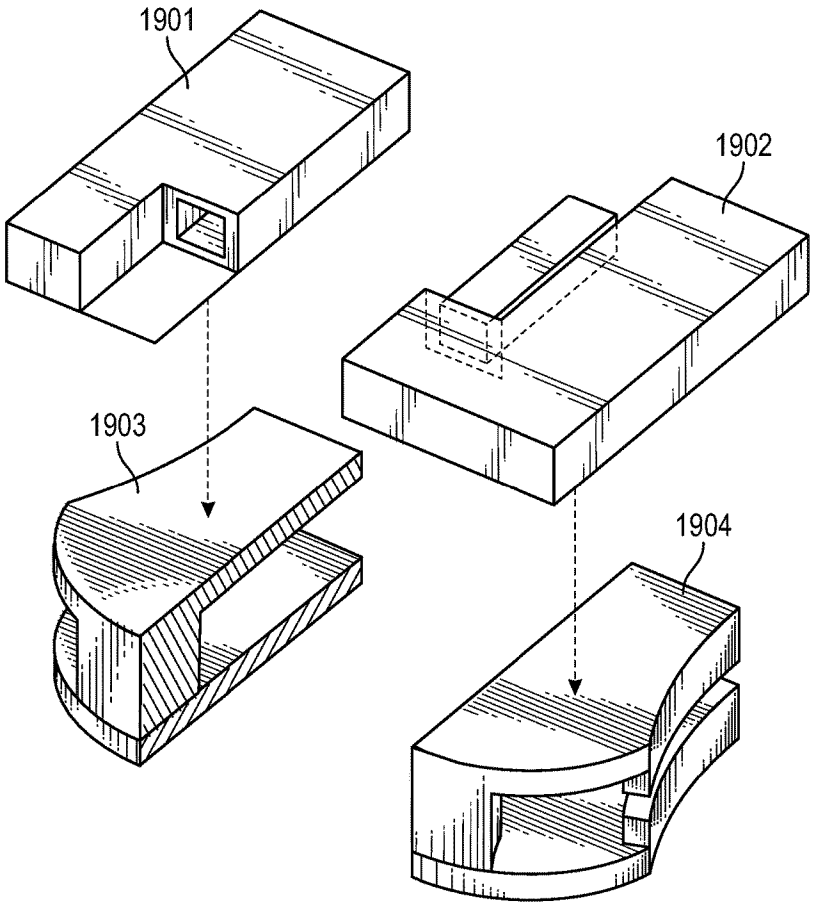
FIG. 19 illustrates an embodiment of the invention displaying the relationship between a slider holder and its respective slider part.

FIG. 19 displays LHS slider holder 1901 and its relationship to LHS slider 1903, along with RHS slider holder 1902 and its relationship to RHS slider 1904, according to an embodiment. In an embodiment, each slider holder is attached to its respective slider through some kind of adhesive, magnet, weld, or any other practicable way of connecting a slider holder to a slider. In an embodiment a slider holder and its respective slider are manufactured in such a way that the slider holder and slider form a unitary piece.

Figure 20:
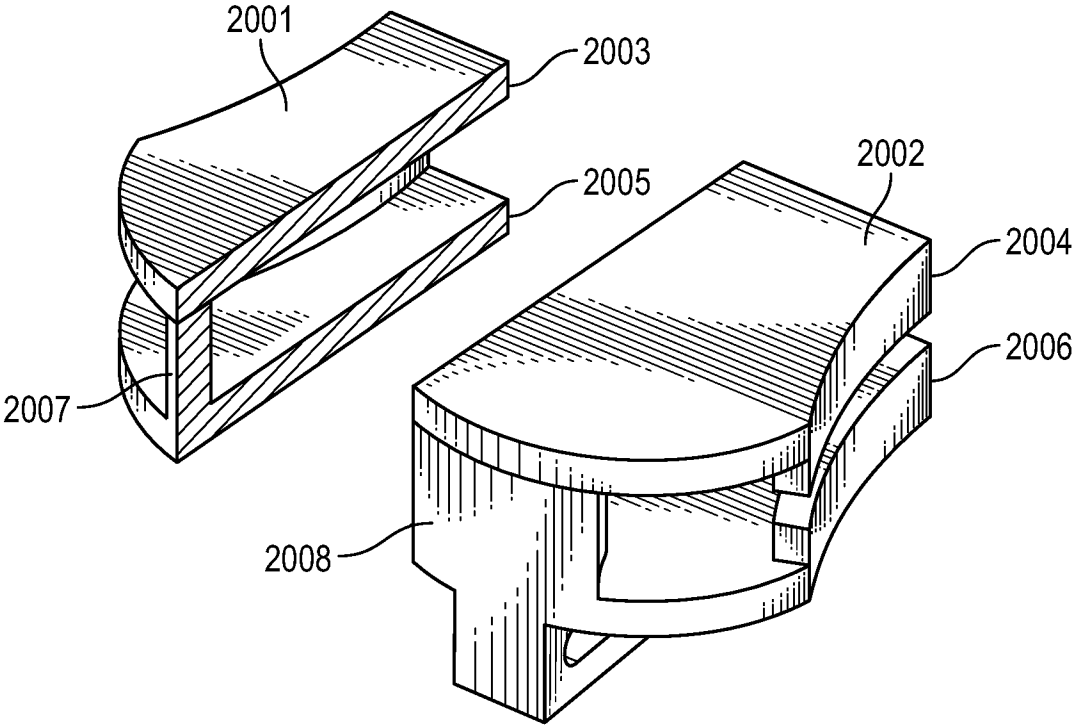
FIG. 20 illustrates an embodiment of the invention including a slider assembly with an asymmetric configuration, including splitter asymmetrically divided between each slider piece.

FIG. 20 displays a perspective view of an embodiment in which LHS slider holder 2001 and RHS slider holder 2002 are not equally sized, and are symmetric in neither their shape nor their function. In an embodiment, the LHS slider and slider holder need not be symmetric with the RHS slider and RHS slider holder, as long as the two sides, acting together, preserve the zipper functionality. In an embodiment, LHS slider includes LHS top piece 2003 and LHS bottom piece 2005, along with LHS splitter 2007 situated between and serving as a connection between, LHS top piece 2003 and LHS bottom piece 2005. RHS slider includes RHS top piece 2004 and RHS bottom piece 2006, along with RHS splitter located between, and serving as a connection between, RHS top piece 2004 and RHS bottom piece 2006.

Figure 21:
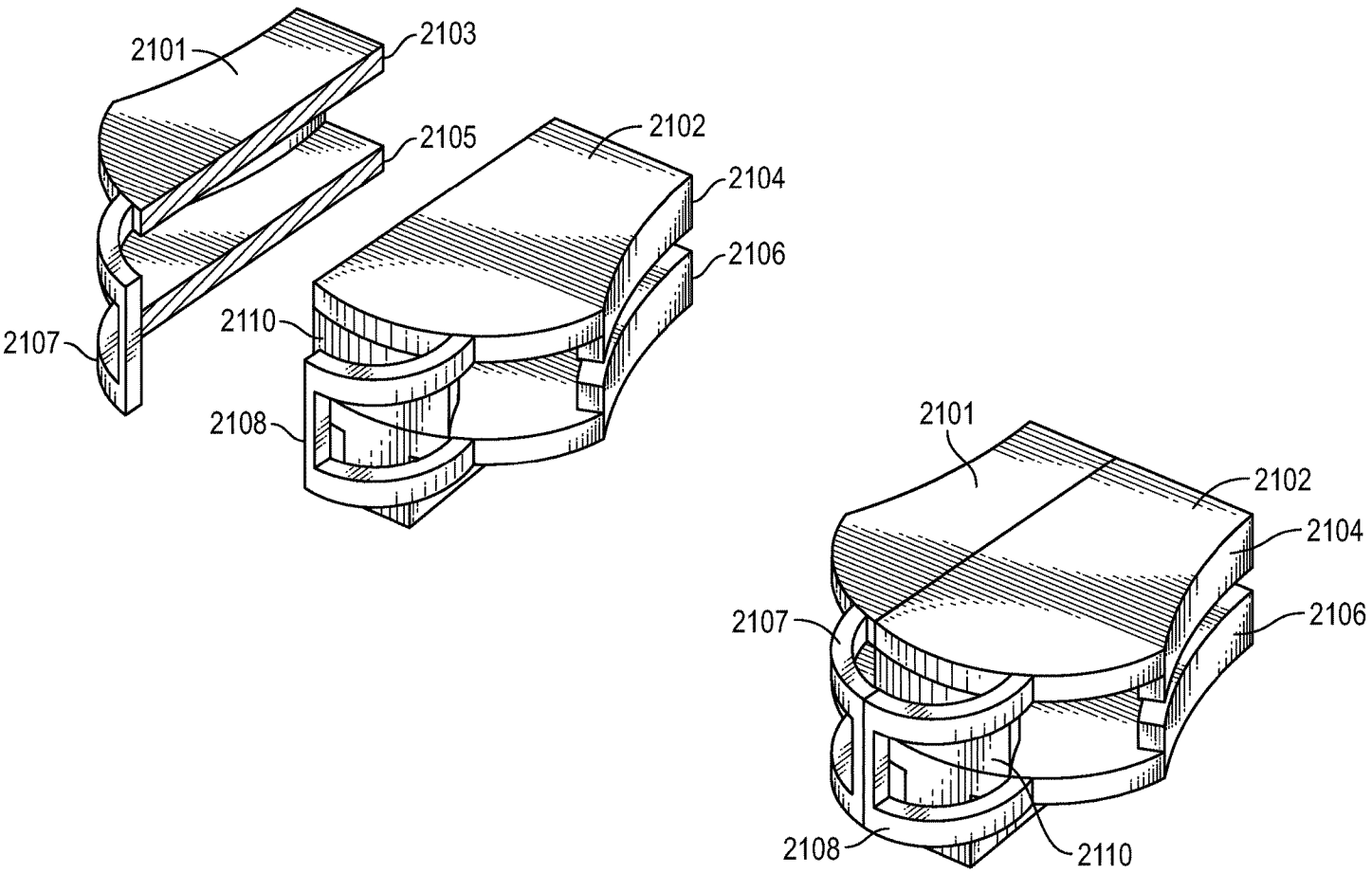
FIG. 21 illustrates an embodiment of the invention including a slider assembly with an asymmetric configuration, including a splitter and an external support member.

FIG. 21 displays a perspective exploded view of an embodiment, including LHS slider 2101 and RHS slider 2102. In an embodiment, LHS slider 2101 includes LHS top piece 2103 and LHS bottom piece 2105, connected by LHS support member 2107, which is located external to LHS top piece 2103 and LHS bottom piece 2105, and which extends externally from LHS slider 2101 substantially parallel to a plane that is parallel to both LHS top piece 2103 and LHS bottom piece 2105. In an embodiment, LHS support member 2107 is configured to work in concert with LHS top piece 2103 and LHS bottom piece 2105 to help guide LHS zipper chain through LHS slider 2001.

In an embodiment, RHS slider 2102 includes RHS top piece 2104 and RHA bottom piece 2106, and RHS splitter 2110 located substantially between RHS top piece 2104 and RHS bottom piece 2106, which can serve as a connection between RHS top piece 2104 and RHS bottom piece 2106. In an embodiment RHS splitter 2110 is substantially wedge shaped, and no LHS splitter exists. In an embodiment, RHS slider 2102 includes RHS support member 2108, which is located external to RHS top piece 2104 and RHS bottom piece 2106, and which extends externally from RHS slider 2102 parallel to a plane that is parallel to both RHS bottom piece 2104 and RHS top piece 2106. In an embodiment, RHS support member 2108 is configured to work in concert with RHS top piece 2104 and RHS bottom piece 2106 to help guide RHS zipper chain through RHS slider 2002. One skilled in the art will understand that both RHS and LHS support members may be configured in any way operable to allow a slider to slide along a zipper chain.

Figure 22:
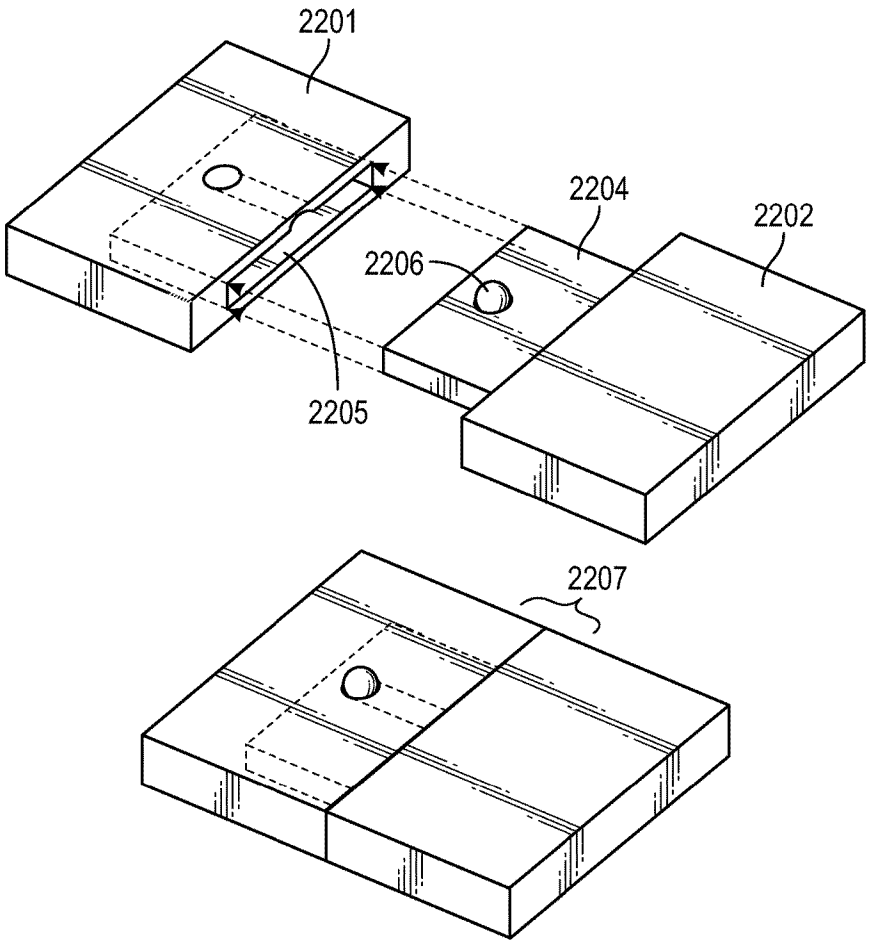
FIG. 22 illustrates an embodiment of the invention including a left-hand slider holder and right-hand slider holder, and a push-button spring activated locking pin mechanism.

FIG. 22 displays a perspective view of an embodiment of the invention, in which LHS slider holder 2201 is configured to couple with RHS slider holder 2202 by inserting tab 2204 into slot 2203. In one embodiment, tab 2204 includes a push button spring activated locking pin, 2206, which, when inserted into slot 2213, can extend through, and lock into, pin hold 2205, thus securing the two pieces together to create single slider holder 2207. As in other embodiments, the LHS and RHS slider holders can be manufactured and attached to their respective LHS and RHS sliders, or can be manufactured as a single piece, so that LHS slider holder is formed as part of an LHS slider, and the RHS slider holder is formed as a part of RHS slider. This provides for two pieces to manufacture, rather than four.

A variety of locking mechanisms to hold together the LHS slider holder and the RHS slider holder have been shown. In practice, many different types of connection can be used. For example, in some embodiments, the locking mechanism is a magnet to hold the two pieces together (see FIG. 10, 1005 and 1006). In another embodiment, a magnet is used as part of tab and slot mechanism to help hold the LHS and RHS pieces together. In some embodiments, the LHS and RHS slider holder are found on a front side of LHS and RHS slider, respectively. In other embodiments, the LHS and RHS slider holders are found on the back side of the LHS and RHS slider, respectively. In some embodiments, the LHS slider holder can be located on the RHS slider, and the RHS slider holder can be located on the LHS slider.

One skilled in the art will understand that, for the purposes of the present invention, the various components described herein can be constructed from any practicable material, including nylon, aluminum, and others. In addition, one skilled in the art will understand that the slider holder can be any size, providing certain advantages when the slider holder is made larger, such as make the slider holder easier to grasp. One skilled in the art will appreciate that the slider holder can be of any size and shape appropriate for grasping and manipulating.

One skilled in the art will understand that the terms LHS slider is synonymous with the term left-hand slider and left-hand side slider, RHS slider is synonymous with the term right-hand slider and right-hand side slider, LHS slider holder is synonymous with the term left-hand slider holder and left-hand side slider holder, and RHS slider holder is synonymous with the term right-hand slider holder and right-hand side slider holder.

Although specific features of the invention are shown in some drawings and not in others, this is for convenience only as each feature may be combined with any or all of the other features in accordance with the invention. The words "including," "comprising," "having," and "with," as used herein, are to be interpreted broadly and comprehensively. Moreover, any embodiments disclosed in the subject application are not to be taken as the only possible embodiments.

I claim:

1. An apparatus for joining two pieces of material, comprising:

a left-hand side slider configured to slide along a left-hand side zipper teeth, the left-hand side slider including a left-hand side top piece, a left-hand side bottom piece, and a left-hand side splitter between and in contact with both the left-hand side top piece and the left-hand side bottom piece such that the left-hand side top piece is fixedly coupled to the left-hand side bottom piece by the left-hand side splitter;

a right-hand side slider configured to slide along a right-hand side zipper teeth, the right-hand side slider including a right-hand side top piece, a right-hand side bottom piece, and a right-hand side splitter between and in contact with both the right-hand side top piece and the right-hand side bottom piece such that the right-hand side top piece is fixedly coupled to the right-hand side bottom piece by the right-hand side splitter;

the left-hand side slider and right-hand side slider further configured to be substantially in contact with each other such that they are capable of sliding substantially in unison along the left-hand side zipper teeth and right-hand side zipper teeth such that, when slid in one direction in unison, the left-hand side slider and right-hand side slider will mechanically connect the left-hand side zipper teeth to the right-hand side zipper teeth, and when moved in another direction in unison, will mechanically disconnect the left-hand side zipper teeth from the right-hand side zipper teeth.

2. The apparatus of claim 1, further comprising:

a left-hand side slider holder coupled to the left-hand side slider;

a right-hand side slider holder coupled to the right-hand side slider;

wherein the left-hand side slider holder and right-hand side slider holder are configured to be coupled to each other to form a single slider holder.

3. The apparatus of claim 2 further including at least one magnet, and wherein the left-hand side slider holder is configured to be held to the right-hand side slider holder using said at least one magnet.

4. The apparatus of claim 2, wherein the left-hand side slider holder includes a substantially u-shaped left-hand side cut-out area forming a left-hand side tab, right-hand side slider holder includes a substantially u-shaped right-hand side cut-out area forming a right-hand side tab, and wherein the left-hand side cut-out area is configured to receive the right-hand side tab, and the right-hand side cut-out area is configured to receive the left-hand side tab, such that when then right-hand side tab is inserted into the left-hand side cutout area, and the left-hand side tab is inserted into the right-hand side cutout area, then left-hand side slider holder and right-hand side slider holder are substantially in contact with each other such that left-hand side slider and right-hand side slider are capable of acting as a single slider holder.

5. The apparatus of claim 2, wherein left-hand side slider holder includes an internal slot with a substantially rectangular opening, and wherein right-hand side slider holder includes an external tab with a substantially rectangular cross section that the external tab is configured to fit substantially snugly into the internal slot in a way that, once inserted, forms a substantially unitary slider holder.

6. The apparatus of claim 2, wherein the left-hand side slider holder includes a slot, and wherein the right-hand side slider holder includes a tab configured to be inserted into the slot in such a way as to couple the left-hand side slider holder to the right-hand side slider holder.

7. The apparatus of claim 6, wherein the slot includes a pin holder, and wherein the tab includes a locking pin configured to be extend into the pin holder in a way that locks the right-hand side slider holder to the left-hand side slider holder.

8. The apparatus of claim 2, wherein the left-hand side slider holder and right-hand side slider holder are not substantially symmetric.

9. An apparatus for zipping two pieces of material together, comprising:

left-hand side zipper teeth;

right-hand side zipper teeth;

a left-hand side slider including a left-hand side upper piece, a left-hand side lower piece, and a left-hand side splitter, the left-hand side upper piece and left-hand side lower piece connected by a left-hand side splitter, the left-hand side slider slidably connected to the left-hand side zipper teeth;

a right-hand side slider including a right-hand side upper piece, a right-hand side lower piece, and a right-hand side splitter, the right-hand side upper piece and right-hand side lower piece connected by a right-hand side splitter, the right-hand side slider slidably connected to the right-hand side zipper teeth;

the left-hand side slider and right-hand side slider further configured to be substantially in contact with each other such that they are capable of sliding substantially in unison along the left-hand side zipper teeth and right-hand side zipper teeth such that, when slid in one direction in unison, the left-hand side slider and right-hand side slider will mechanically connect the left-hand side zipper teeth to the right-hand side zipper teeth, and when moved in another direction in unison, will mechanically disconnect the left-hand side zipper teeth from the right-hand side zipper teeth;

a left-hand side slider holder coupled to the left-hand side slider upper piece; and a right-hand side slider holder coupled to the right-hand side slider upper piece, wherein the left-hand side slider holder and right-hand side slider holder are configured to attach to each other such that a contact surface of the left-hand side slider and a contact surface of the right-hand side slider are substantially in contact with each other.

10. The apparatus of claim 9, wherein the left-hand side slider holder includes a slot, and wherein the right-hand side slider holder includes a tab configured to be inserted into the slot in such a way as to couple the left-hand side slider holder to the right-hand side slider holder, and that places the contact surface of the left-hand side slider into contact with the right-hand side slider.

11. The apparatus of claim 10, wherein the slot includes a pin hold, and wherein the tab includes a locking pin configured to be extend into the pin hold in a way that locks the right-hand side slider holder to the left-hand side slider holder while keeping the contact surface of left-hand side slider in contact with the contact surface of right-hand side slider.

12. The apparatus of claim 9 further including at least one magnet, and wherein the left-hand side slider holder is configured to be coupled to the right-hand side slider holder using the at least one magnet in a way that places the contact surface of left-hand side slider in contact with the contact surface of right-hand side slider.

13. The apparatus of claim 9, wherein the left-hand side slider holder includes a substantially u-shaped left-hand side cut-out area forming a left-hand side tab, right-hand side slider holder includes a substantially u-shaped right-hand side cut-out area forming a right-hand side tab, and wherein the left-hand side cut-out area is configured to receive the right-hand side tab, and the right-hand side cut-out area is configured to receive the left-hand side tab, such that when then right-hand side tab is inserted into the left-hand side cutout area, and the left-hand side tab is inserted into the right-hand side cutout area, then left-hand side slider holder and right-hand side slider holder are substantially in contact with each other such that left-hand side slider and right-hand side slider are capable of acting as a single slider holder.

14. The apparatus of claim 9, wherein left-hand side slider holder includes an internal slot with a substantially rectangular cross-sectional opening, and wherein right-hand side slider holder includes an external tab with a substantially rectangular cross section such that the external tab is configured to fit substantially snugly into the internal slot in a way that, once inserted, allows left-hand side slider and right-hand side slider to act as a single slider.

15. An apparatus, comprising:

a left-hand side slider including a left-hand side splitter and configured to slide along left-hand side zipper teeth;

a right-hand side slider including a right-hand side splitter and configured to slide along right-hand side zipper teeth;

the left-hand side slider and right-hand side slider configured to be in contact with each other such that the left-hand side splitter and right-hand side splitter are capable of acting as a single splitter such that, when slid in one direction in unison, the left-hand side slider and right-hand side slider will mechanically connect the left-hand side zipper teeth to the right-hand side zipper teeth, and when moved in another direction in unison, will mechanically disconnect the left-hand side zipper teeth from the right-hand side zipper teeth.

16. The apparatus of claim 15, further comprising:

a left-hand side slider holder in contact with the left-hand side slider;

a right-hand side slider holder in contact with the right-hand side slider;

wherein the left-hand side slider holder and the right-hand side slider holder are configured to attach to each other in a way that allows the left-hand side slider and right-hand side slider to move in unison.

17. The apparatus of claim 16, wherein the left-hand side slider and right-hand side slider are sized asymmetrically.

18. The apparatus of claim 17, wherein the left-hand side slider holder includes a left-hand side top piece fixedly connected to a left-hand side bottom piece by a left-hand side support member configured to extend in a plane substantially parallel to the left-hand side top piece and left-hand side bottom piece, the left-hand side support member configured to guide a first zipper chain between the left-hand side top piece and left-hand side bottom piece.

19. The apparatus of claim 18, wherein the right-hand side slider holder includes a right-hand side top piece fixedly connected to a right-hand side bottom piece by a splitter situated substantially between the right-hand side top piece and right-hand side bottom piece.

20. The apparatus of claim 18, further including a right-hand side top piece fixedly connected to a right-hand side bottom piece by a right-hand side splitter situated between right-hand side top piece and right-hand side bottom piece.

* * * * *